US005345854A

United States Patent [19]

Schieferle et al.

[11] Patent Number: 5,345,854

[45] Date of Patent: Sep. 13, 1994

[54] DEVICE TO SEAL THE CARTRIDGE CHAMBER ON HAND WEAPONS

[75] Inventors: Reinhard Schieferle, Münster, Austria; Nehemia Sirkis, Los Angeles, Calif.

[73] Assignees: VOERE Kufsteiner Geratebau-und Handelsgesellschaft m.b.h., Kufstein; PSE Produkt-und Systementwicklungsgesellshaft m.b.h., Ampass, both of Austria

[21] Appl. No.: 969,288

[22] PCT Filed: Jul. 13, 1991

[86] PCT No.: PCT/EP91/01318

§ 371 Date: Mar. 17, 1993

§ 102(e) Date: Mar. 17, 1993

[87] PCT Pub. No.: WO92/01901

PCT Pub. Date: Feb. 6, 1992

[30] Foreign Application Priority Data

Jul. 19, 1990 [AT] Austria ..... 1531/90
Mar. 14, 1991 [AT] Austria ..... 565/91

[51] Int. Cl.[5] ..... F41A 3/74
[52] U.S. Cl. ..... 89/26; 42/25
[58] Field of Search ..... 89/26, 19, 20.2, 20.4, 89/21, 7; 42/16, 25; 102/700

[56] References Cited

U.S. PATENT DOCUMENTS

| | | | |
|---|---|---|---|
| 270,299 | 1/1883 | Freyre | 89/26 |
| 2,473,555 | 6/1949 | Weiss | 89/26 |
| 3,008,258 | 11/1961 | Johnson | 89/26 |
| 3,114,290 | 12/1963 | Harvey et al. | 89/26 |
| 3,299,812 | 1/1967 | Suh et al. | 89/26 |
| 3,530,762 | 9/1970 | Batie et al. | 89/7 |
| 3,613,500 | 10/1971 | Warin | 89/26 |
| 3,783,737 | 1/1974 | Ashley | 89/7 |
| 4,051,762 | 10/1977 | Ashley | 89/7 |

FOREIGN PATENT DOCUMENTS

| | | | |
|---|---|---|---|
| 293229 | 9/1971 | Austria . | |
| 310040 | 9/1973 | Austria . | |
| 317726 | 9/1974 | Austria . | |
| 416453 | 7/1936 | Belgium . | |
| 1579 | 11/1889 | Switzerland | 89/26 |
| 6873 | of 1893 | United Kingdom | 89/26 |
| 687826 | 2/1953 | United Kingdom . | |

*Primary Examiner*—Stephen M. Johnson
*Attorney, Agent, or Firm*—Lorusso & Loud

[57] ABSTRACT

A device for sealing the cartridge chamber of a small arms weapon that fires a caseless cartridge consisting of a propellant charge and a bullet that is connected to the propellant charge. The device includes a pot-shaped seal having a base and a side. The seal is disposed on the weapon's butt front edge so that at least a portion of the side's outer surface presses on an adjacent inner surface of the cartridge chamber when the butt is closed. The outer surface further sealingly engages the chamber adjacent inner surface in response to the gas pressure from the propellant charge when the cartridge is fired. The side's outer surface is defined by a first generatrix that is parallel to the chamber axis and the adjacent chamber inner surface is defined by a second generatrix, where the first and second generatrices converge. The seal further includes a replaceable insert that is secured to the butt's front edge and is disposed proximate the seal's base so the insert's top front side is adjacent the propellant charge's base. The insert further includes an extractor claw, extending parallel to the chamber axis, that engages a peripheral groove around the propellant charge so an unfired caseless cartridge can be withdrawn from the cartridge chamber.

6 Claims, 4 Drawing Sheets

DEVICE TO SEAL THE CARTRIDGE CHAMBER ON HAND WEAPONS

FIELD OF INVENTION

The invention concerns a device on hand weapons to seal a cartridge chamber for a cartridge without a case that has a bullet and a propellant charge connected to it, with a seal designed in the shape of a pot on the front end of the butt that has a base adjacent to the base of the propellant charge and a side projecting over the base, which seals by a rise in pressure and presses on the inside of the cartridge chamber.

BACKGROUND OF THE INVENTION

Small weapons with such a device can be inferred, for example from Austrian Patents 293 229 and 310 040. The sealing element that locks the cartridge chamber in the back is made of two parts here and includes, on one hand, the butt, which is adjacent to the cartridge chamber on the front, and, on the other hand, a case arranged on the butt that projects over the front, making it generally pot-shaped. The projecting part of the case that includes the propellant charge expands under the pressure of the propellant gas and is pressed onto the inside of the cartridge chamber. Since the resulting gas pressure is quite high, for example 4,000 to 5,000 bar, it has been shown that because of the annular gap between the case and the butt, the seal is not satisfactory, and a loss of pressure occurs that has an effect on the firing. It also means that the base of the pot shape in particular, and if necessary the projecting part of the case, is worn down or damaged.

Austrian Patent 317 726 shows an extractor for cartridges without cases that have a groove around the outside. The butt in this design has an extractor claw that overlaps the propellant charge on one part of the periphery and goes into the peripheral groove. The butt is thus either not coaxial to the running axis or, has a cross section that is not circular, caused by the eccentric extractor claw, so that the design of a bayonet catch is not possible.

The task of the invention is to create a device with an improved, easily produced seal for the cartridge chamber on the side where it locks.

SUMMARY OF THE INVENTION

According to the invention, this is achieved by having the generatrix on the outside of the side of the seal converge with the generatrix of the section on the inside of the cartridge chamber.

Because the two generatrices converge at a common point of contact, the lock is locked by the radial, elastic compression of the seal on all sides, with a sealing press fit on the section of the inner surface of the cartridge chamber. This sealing press is increased even more by the pressure of the gas, and because of the pot-shaped design, no free space, like the annular gap mentioned, can open. The generatrices are preferably straight, but can also be slightly bent curves. Another preferred embodiment provides for the generatrices on the outer surface of the side of the seal to run parallel to the axis of the cartridge chamber. In this case, only the inner surface of the cartridge chamber is conical.

The angle between the two generatrices can be within the range of 0.1° to 15°, and depends inter alia on the elastic deformation dimensions of the material used for the seal. For the steels usually used in weapons production, the angle is preferable 1°. This has given especially good results in practical tests.

The pot-shaped seal can be designed in the front part of the butt, and the inner space of the pot-shaped seal corresponds preferably to the shape of the propellant charge. Since the seal wears out mainly on its base, the base of the seal can have a changeable insert attached to one of the butts. That way, the wear is not reduced, but a changeable part, namely the extra insert is affected, which can be changed and protects the front part of the butt.

One preferred embodiment provides for the insert also to be designed to be shaped like a pot, wherein the side of the seal pressing on the inside of the cartridge chamber is protected from the force of direct gas pressure and the effects of heat. In this case, preferably the inner space of the pot-shaped insert is designed in the shape of the propellant charge. There are many ways of making the insert changeable. One initial design provides for the insert to have a threaded stem held in a hole on the butt. The insert is thus like a screw screwed into the butt whose head is adjacent to the base of the propellant charge. Another embodiment provides for the insert to have a threaded hole and to be screwed onto a threaded stem projecting from a hole in the butt. To attach the threaded stem in the butt, the threaded steam can have a head element, for example a nut, which is supported in an extension of the hole. In a third embodiment, the insert has a threaded hole and screws onto a threaded stem on the front of the butt.

The changeable insert also makes it possible for the side of the seal pressing on the inside of the cartridge chamber on a changeable pot-shaped sealing element to have a hole on the bottom that the threaded stem goes through, so that the sealing element is held by the insert and can be changed. Thus despite the pot-shaped seal, both the design of a bayonet catch and also the arrangement of an extractor claw are possible, so that a cartridge not fired can be withdrawn from the cartridge chamber.

The design for a changeable insert and a changeable sealing element is not linked to the convergence of the generatrices mentioned at the start, but could also be provided with other cartridge chamber seals.

BRIEF DESCRIPTION OF THE DRAWING

The invention will be explained in greater detail below using the enclosed drawings, but is not limited to them.

DESCRIPTION OF THE PREFERRED EMBODIMENT

Figure 1:
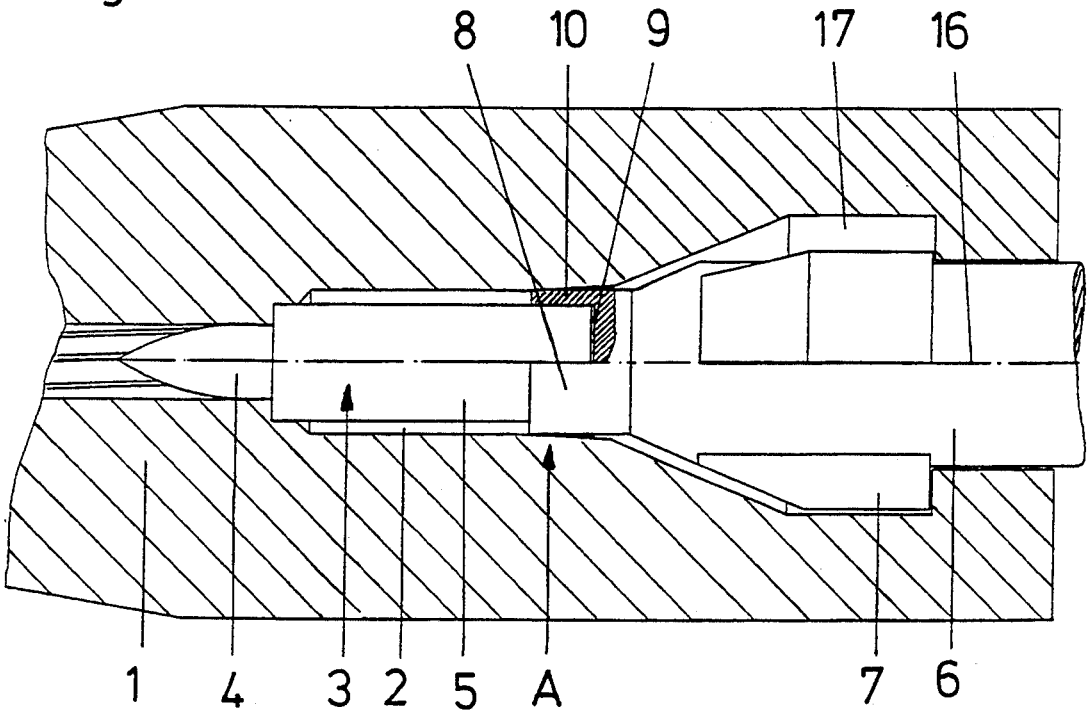
FIG. 1 shows a longitudinal section through the part of the small weapon in the invention.
Figure 2:
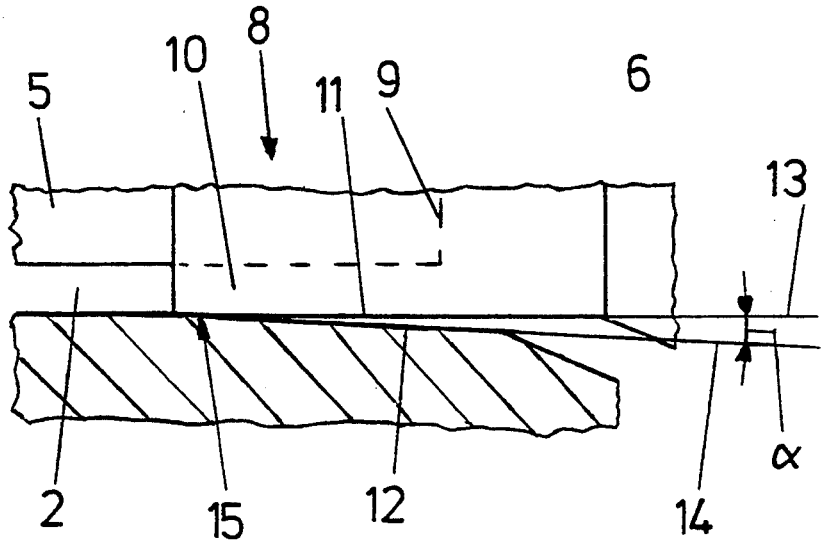
FIG. 2 shows a detail A of the drawing in FIG. 1 greatly enlarged.

A cartridge chamber 2 is designed at the end of the barrel 1 of a small weapon, especially a hunting weapon, and a space 17 for the butt 6 is connected to the side of it facing away from the barrel. It has the usual bolt elements 7, which can be screwed into corresponding recesses in the space 17, depending on the type of bayonet catch. The cartridge 3 used in the cartridge chamber has no case and has a bullet 4 projecting into the barrel 1 as well as a cylindrical propellant charge 5 surrounding the area at the end of the bullet 4. The area at the end of the propellant charge 5 is surrounded by the side 10 of a pot-shaped seal 8, whose base 9 is adjacent to the base, i.e., to the back of the top of the propellant charge 5.

The outer surface 11 of the side 10 of the seal 8 has a generatrix 13, which runs parallel to the axis 16 of the barrel 1 or the cartridge chamber 2. The section 12 on the inside of the cartridge chamber that works with the side 10 has a generatrix 14, which converges with the generatrix 13 at an angle $\alpha$ of preferably 1°. The section 12 of the inside of the cartridge chamber 2 and the outside surface 11 are thus not parallel. The seal 8 is formed by the front end of the butt 6, into which a recess that fits the propellant charge 5 is worked. When the butt 6 is closed by the convergence of the two generatrices 13, 14, the seal 8 presses into the section 12 of the inside of the cartridge chamber 2, so that the elastic deformation of the front end area 15 produces a seal without gas pressure. As soon as the gas pressure is produced, the side 10 expands, and the pressure between the outer surface 11 and the section 12 of the inside increases, so that a seal resistant to high pressure is created.

Figure 3:
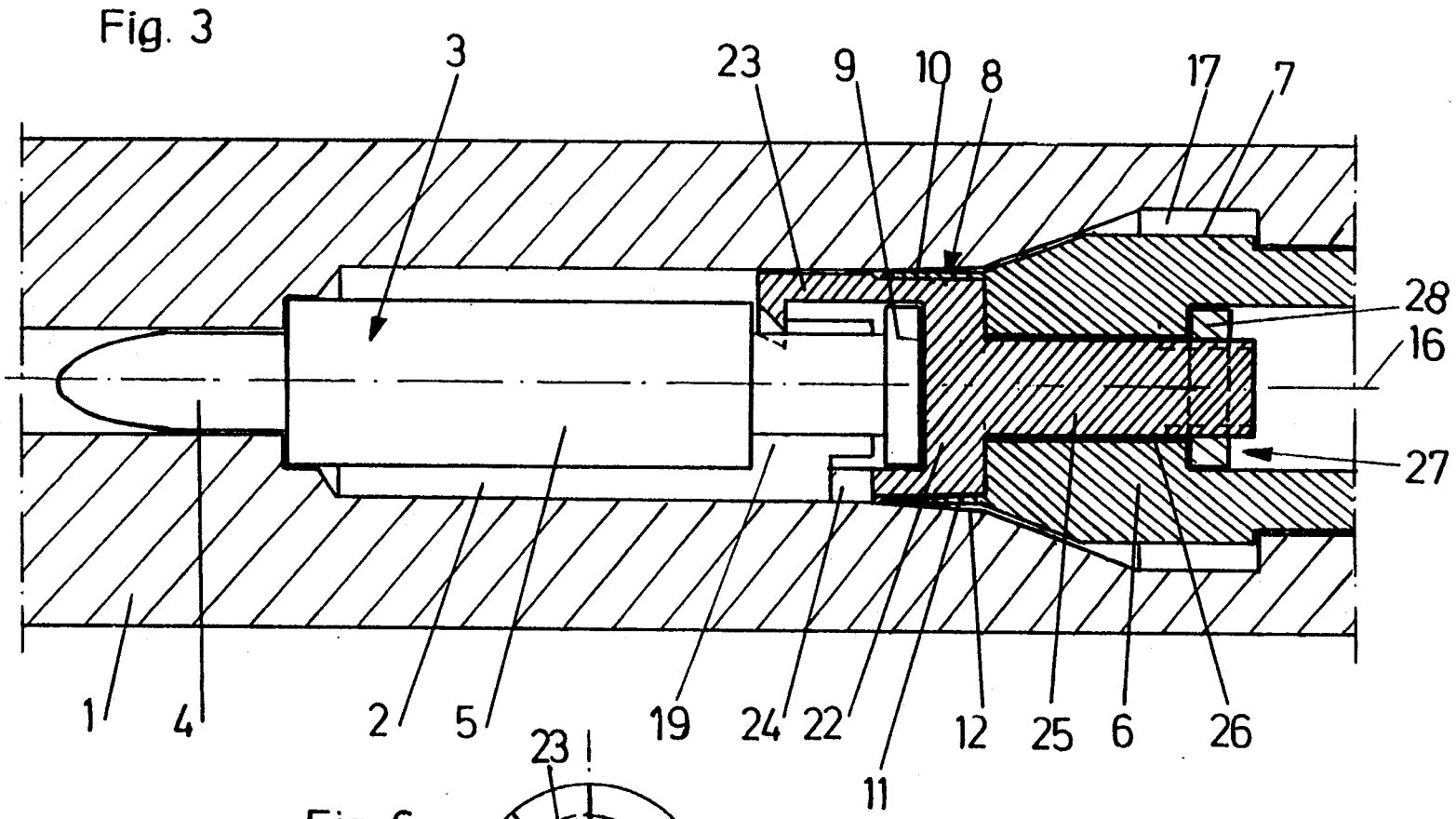
FIGS. 3–5 show longitudinal sections through three other different embodiments and FIG. 6 shows a front view of a preferred embodiment of the insert.

In the design in FIG. 3, the seal 8 also includes a roughly pot-shaped front side of the butt 6, in which the side 10 has the design described. The butt 6 also has an axial hole 26, which meanders into an extension 27 in the back. threaded stem 25 is inserted into the hole 26, and attached with a nut 28 inserted into the extension. The threaded stem 25 is in the middle of an insert 22 that is also pot-shaped, which is held on the butt 6 and can be changed and is inserted into the seal 8, and whose front top side forms the base 9 adjacent to the base of the propellant charge 5.

Figure 4:
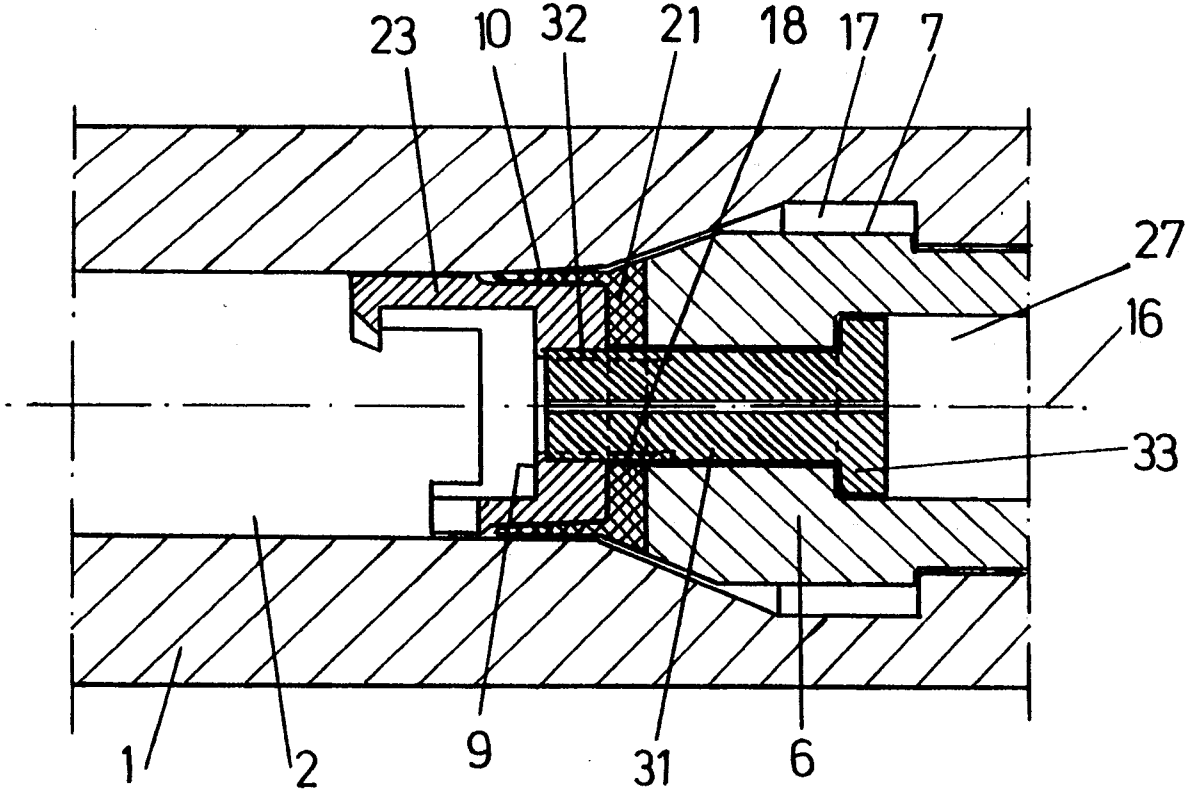

According to FIG. 4, a threaded stem 31 is inserted with its head 33 into the extension 27 of the axial bore hole 26 of the butt 6, which juts out in front. For the seal in this design, a pot-shaped sealing element 21, whose side 10 in turn expands from the gas pressure and presses against the inside of the cartridge chamber 2. The sealing element 21 has a hole in the bottom 18 and is set on the threaded stem 31. The sealing element 21 is attached by the insert 22, which has a threaded hole 32 and is screwed onto the threaded stem 31, and whose base 9 is adjacent to the propellant chamber of the cartridge, not shown here. The sealing element 21 can also be replaced in this design.

Figure 5:
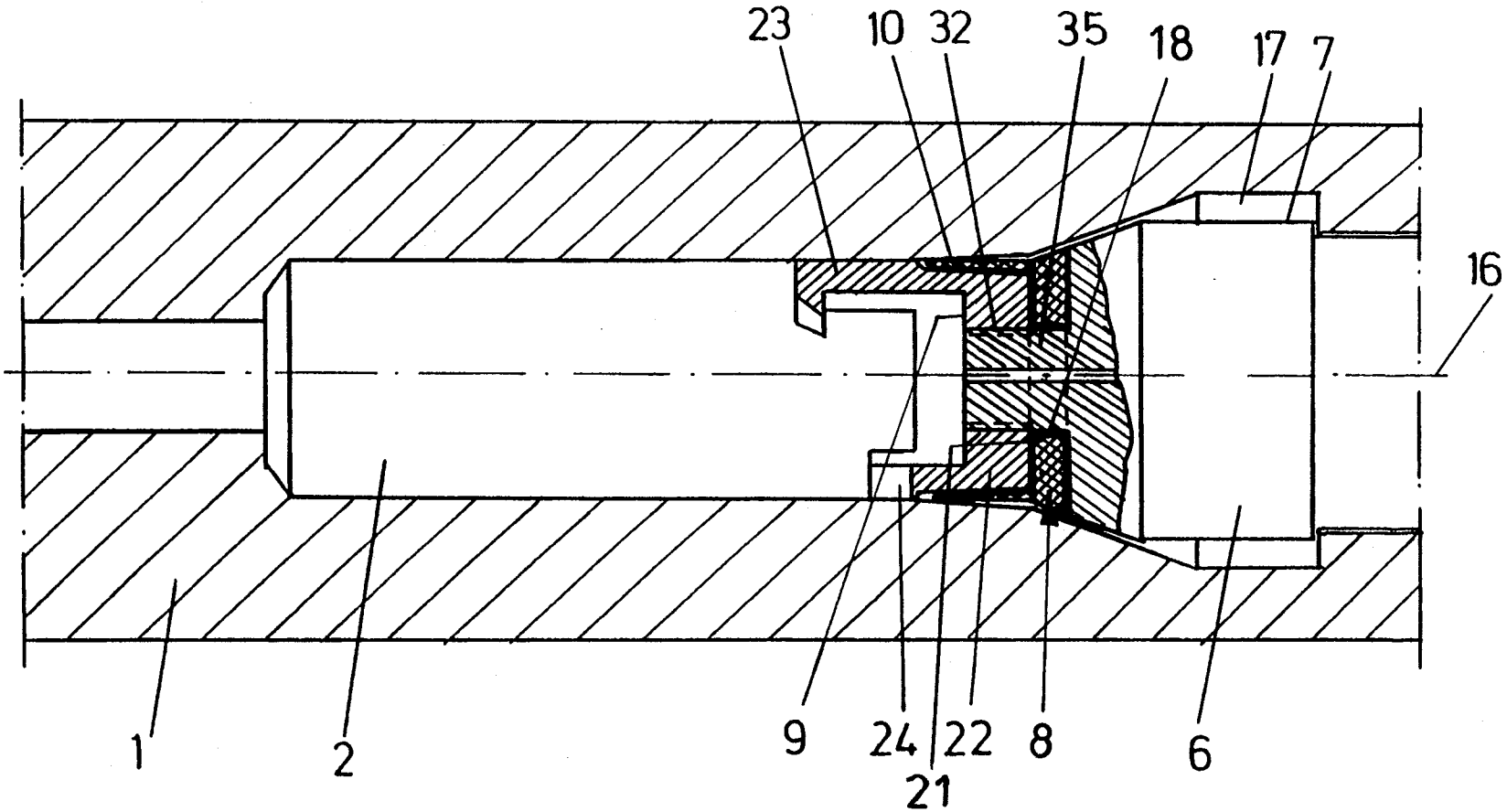

FIG. 5 shows a design in which both the sealing element 21 and the insert 22 are attached to the butt 6 and can be changed. Here, a threaded stem 35 is designed on the front of the butt 6 that goes through the sealing element 21 and is screwed onto the insert 22. To fire the cartridge 3, an ignition channel is shown in FIGS. 4 and 5, which goes through the threaded stem 31, 32. However, it could also be fired from the periphery.

Figure 6:
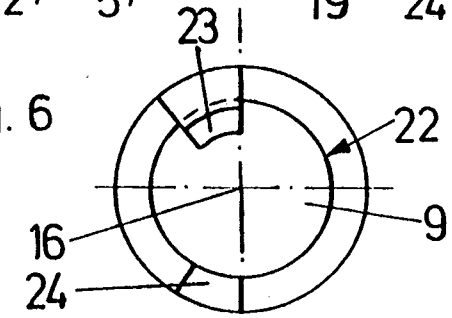

To withdraw a cartridge 3 not fired, the pot-shaped insert 22 has an extractor claw 23, which goes into a peripheral groove 19 around the propellant charge 5. A guide ridge 24 is arranged opposite the extractor claw 23 whereby, as can be seen in FIG. 6, the extractor claw 23 and the guide ridge 24 are designed on half of the periphery, so that the cartridge can be pushed onto the second half of the periphery perpendicular to the axis 16.

What is claimed is:

1. A device for sealing a cartridge chamber, having an axis, of a small arms weapon that fires a caseless cartridge consisting of a propellant charge, having a base, and a bullet that is connected to the propellant charge, said device comprising:

a pot-shaped seal, said seal having a base and a side, where said side projects over the base and has an outer surface;

wherein the weapon further includes a butt having a front edge, where said seal is disposed on the butt front edge so that at least a portion of said side outer surface presses on an adjacent inner surface of the cartridge chamber when the butt is closed;

wherein said side outer surface is defined by a first generatrix, said first generatrix being parallel to the chamber axis and the adjacent chamber inner surface is defined by a second generatrix, where said first and second generatrices converge;

wherein said side outer surface further sealingly engages the chamber adjacent inner surface in response to gas pressure from the propellant charge when the cartridge is fired;

wherein said seal further includes a replaceable insert having a top front side, said insert top front side being disposed proximate said seal base so said insert top front side is adjacent the base of the propellant charge;

wherein said insert is secured to the butt so said insert is replaceable; and wherein said insert further includes an extractor claw extending parallel to the chamber axis, said extractor claw for engaging a peripheral groove around the propellant charge so an unfired caseless cartridge can be withdrawn from the cartridge chamber.

2. The device of claim 1, wherein said first generatrix and said second generatrix converge at an angle in the range of 0.1°to 15°.

3. The device of claim 2, wherein said angle of convergence between said first generatrix and said second generatrix is 1°.

4. The device of claim 1, wherein said replaceable insert is pot shaped.

5. The device of claim 1, wherein said replaceable insert further includes a threaded aperture, wherein the butt further includes a threaded stem projecting outward from the butt front edge, and wherein said replaceable insert is secured to the butt by screwing said threaded aperture onto said threaded stem.

6. The device of claim 5, wherein said seal further includes a replaceable pot-shaped sealing element having a side and a base, said sealing element side having an outer surface a portion of which presses on said chamber adjacent inner surface when the butt is closed, wherein said sealing element base has an aperture, wherein said threaded stem passes through said element aperture and is threaded into said insert threaded aperture to secure both said sealing element and said insert to the butt.

* * * * *